United States Patent [19]

Morcher et al.

[11] 4,148,943

[45] Apr. 10, 1979

[54] PROCESS FOR THE PREPARATION OF MATTED PHOTOGRAPHIC LAYERS CONTAINING GELATINE

[75] Inventors: Bernhard Morcher; Rolf Brück, both of Leverkusen, Fed. Rep. of Germany

[73] Assignee: AGFA-Gevaert AG, Leverkusen, Fed. Rep. of Germany

[21] Appl. No.: 687,611

[22] Filed: May 18, 1976

[30] Foreign Application Priority Data

May 22, 1975 [DE] Fed. Rep. of Germany ..... 2522692

[51] Int. Cl.[2] ..... B05D 5/00

[52] U.S. Cl. ..... 427/256; 96/67; 96/114.8; 106/135; 264/5; 427/384

[58] Field of Search ..... 427/180, 384, 385 R, 427/338, 203, 256; 96/114.8, 67; 428/474, 475; 260/117; 106/125, 288, 135, 288 Q; 264/5

[56] References Cited

U.S. PATENT DOCUMENTS

| | | | |
|---|---|---|---|
| 2,043,906 | 6/1936 | Sheppard | 428/475 |
| 2,731,347 | 1/1956 | Gray | 96/114.8 |
| 3,640,809 | 2/1972 | Polson et al. | 260/117 |
| 3,666,532 | 5/1972 | Reedy et al. | 428/474 |
| 3,717,469 | 2/1973 | Slonimsky et al. | 260/117 |

OTHER PUBLICATIONS

Stauff, J. *Kolloidchemie,* Springer Verlag, Berlin, 1960, pp. 509–519.

*Primary Examiner*—Ronald H. Smith
*Assistant Examiner*—Janyce A. Bell

[57] ABSTRACT

In a process for the preparation of matted photographic layers gelatine particles which are dispersed in a water-in-oil emulsion are hardened, separated from the emulsion, redispersed in water, added to the layer which is required to be matted, and the casting composition is applied to a substrate and dried.

3 Claims, No Drawings

PROCESS FOR THE PREPARATION OF MATTED PHOTOGRAPHIC LAYERS CONTAINING GELATINE

This invention relates to a process for the preparation of matted photographic layers using modified gelatine.

It is known to use dispersions of inorganic or organic pigments or synthetic resins for rendering photographic layers matt. All these matting agents have the disadvantage of having a distinctly different refractive index from that of gelatine which is used as binder for the photographic layers and generally constitutes the major component of such layers. The matting agents cause substantial clouding of the photographic layers and thereby reduce the sharpness of the image. In addition, they have no capacity to swell, they act as foreign bodies in the layers and they have a damaging effect on the mechanical properties of the layers and interfere with the diffusion processes in photographic development.

It is also known to produce matted photographic layers by milling gelatine powder in a volatile organic solvent such as ethyl alcohol which contains formaldehyde, displacing the solvent with another, non-polar organic solvent such as benzene, evaporating off the non-polar solvent and using the hardened gelatine powder for matting the photographic layers, if necessary first redispersing the powder in water as described in U.S. Pat. No. 2,043,906. One disadvantage of this process, however, is that even the most vigorous milling can only produce relatively coarse particles which moreover vary considerably in size. The matt effect produced in photographic layers containing these substances is too coarse for most purposes.

It is therefore an object of this invention to develop a process by which a more uniform and finer matt effect can be obtained and which enables the degree of matting to be adjusted to different requirements with quite simple means and which avoids optical defects due to the matting agent.

The invention relates to a process for the preparation of matted photographic layers containing gelatine, using hardened gelatine particles as matting agent, in which gelatine particles which are dispersed in a water-in-oil emulsion containing a non-polar solvent as organic phase in the presence of emulsifiers preferably having an HLB value of from 3 to 8("hydrophilic-lipophilic balance"; see house magazine of Atlas Chemical Industries, 1963 "Das Atlas HLB-System") and a hardener are hardened, after separation from the emulsion and redispersion in water the hardened gelatine particles are added to the casting composition of the layer which is required to be matted, the quantity to be added being calculated so that its proportion of the dry weight of the binder content of the layer is not greater than 50% by weight, and the casting composition is applied to a substrate and dried.

The aqueous dispersions of hardened gelatine particles used as matting agents according to the invention are obtained used as matting agents according to the invention are obtained from aqueous gelatine solutions which are first emulsified in a non-polar organic solvent with the aid of emulsifiers to form a water-in-oil emulsion in known manner. A hardener which is soluble in the non-polar solvent is then added to the gelatine emulsion. The hardened gelatine particles are generaed from the emulsion, the organic solvent is removed and the gelatine particles are finally redispersed in water. A description of the W/O emulsification process and of suitable emulsifiers and apparatus for this process is given by J. Stauff in Kolloichemie, Springer-Verlag 1960, pages 509–519. Examples of suitable non-polar organic solvents for the preparation of the oil-in-water emulsions include higher boiling petroleum hydrocarbons such as cleaning petrol or ligroin, higher boiling paraffins such as $C_6$ to $C_{16}$ hydrocarbons, toluene, xylenes, monoethyl-, diethyl, triethyl- or propylbenzene, mesitylene, tetramethyl- and pentamethylbenzene, further biphenyl, diphenylmethane, perchloroethylene and carbon tetrachloride.

Any of the known water-in-oil emulsifiers may be used for emulsifying the aqueous phase in the oil phase, preferably those with low HLB values (hydrophilic-lipophilic balance; see house magazine of Atlas Chemical Industries, 1963 "Das Atlas HLB-System") and preferably HLB values of from 3 to 8. An emulsifier which has proved to be particularly suitable for the system of cleaning petrol/aqueous gelatine solution consists of a mixture of glycerol monodioleate and polyethylene glycerol monooleate used in proportions by weight of 6:4 while sorbitan dioleate is particularly suitable for the system perchloroethylene/gelatine solution. Other examples of suitable emulsifiers include the monooleate, stearate, laurate and palmitate of sorbitan; polyoxyethylene-sorbitan fatty acid esters, i.e. reaction products of 1 mol of the given sorbitan fatty acid ester and 4 to 40 mol of ethylene oxide, and polyoxyethylene sorbitol esters of fatty acids and resinic acids and mixtures thereof. Further suitable emulsifiers may be found in "Ullmans Encyklopädie der technischen Chemie", 4. Aufl. Bd. 1o, pages 462 and 463, tables 3, 4 and 5. The concentration of the emulsifier generally depends on the used system solvent/emulsifier. In some cases concentrations of only 1% by weight of emulsifier are suitable, in particular if immediately after the emulsification the mixture is cooled down to room temperature. A survey of emulsifiers suitable for the process according to the invention and their HLB values may be found in the report by F.Hölscher "Dispersionen synthetischer Hochpolymerer" from the series "Chemie, Physik und Technologie der Kunststoffe in Einzeldarstellungen" (Springer-Verlag 1969), pages 58 and 59, and Schlick "Nonionic Surfactants" Vol. 1, pages 690–611.

Any of the known hardenable gelatines may be used in the process of the invention, i.e. as well acid treated as alkaline treated gelatines or mixtures thereof, further the numerous hardenable gelatine derivatives or modified gelatines such as described for example in the U.S. Pat. Nos. 2,920,068, 3,061,436, 3,782,955, 2,794,787, 2,713,575 or 2,688,610.

Moreover it is possible to replace gelatine in the process of the invention by other highmolecular substances which are hardenable. As examples may be mentined synthetic polypetides, watersoluble cellulose derivatives, vinyl- or acryl-polymers or -copolymers containing carboxylic acid-, sulfonic acid- or acid amide groups. The polymers may be hardened by means of the known hardening agents reacting with carboxylic and amino groups.

The hardeners used should be at least partly soluble in the organic solvent. Although hardeners which are insoluble in the organic solvent could conceivably also be emulsified in the water-in-oil emulsion, it is then necessary to ensure that the hardening reaction does not set in until the emulsion has been completely prepared. This can be achieved, for example, by using a slow acting hardener. Formalin, glyoxal and pentadialdehyde are examples of suitable hardeners although others could also be chosen from the long list of compounds known as hardeners for photographic layers provided that they harden sufficiently slowly not to interfere with the preparation of the water-in-oil emulsion.

However, it is also possible to use so-called fast acting hardeners such as carbamoyl pyridinium or carbamoyloxy pyridinium salts as described in the U.K. Patent Specification No. 1,383,630, the German Offenlegungsschrift No. 2,439,551 and the Belgian Patent Specification No. 825,726, carbodimimides as described in the U.S. Pat. Nos. 2,938,892 or 3,098,693, dihydroquinoline compounds as described in the Belgian Patent Specification and isoxazolium salts and bis-isoxazoles are described in the U.S. Pat. Nos. 3,316,095, 3,321,313, 3,543,292 and 3,681,372 or the U.K. Patent Specification No. 1,030,882. The application of fast acting hardeners requires a certain modification of the emulsifying process which will be explained in the following.

It may still be mentioneed that a slow reacting hardener such as triacrylformal or chromium acetate can be added to the aqueous gelatine solution already before the preparation of the emulsion. After emulsification the reaction of the hardener can be accelerated by changing the pH-value of the mixture, by increase of the temperature or by distilling off the bulk of the water from the W/O system, preferably under vacuum at room temperature. If fast reacting hardeners are used, the operating time must be adapted to the reaction time of the hardener, i.e. the period of emulsification must be shorter than the reaction time of the hardener. On the other hand it is possible to carry out the emulsification at pH ranges wherein the reactivity of the hardener is low and then to adjust the pH value, for example by adding volatile or easily soluble bases or acids such as ammonia or acetic acid, to the optimum pH at which the hardener develops its optimum reactivity.

The preferred and simplest procedure of course comprises as a first technological step the emulsification of the gelatin solution up to the desired fineness of the gelatine particles and as the second chemical step the hardening of the obtained gelatine particles. In the second step for example the hardener can be added in solid form if it is soluble in the organic solvent to some extend and can diffuse into the aqueous medium. However, the most favourable method consists of preparing the W/O-gelatine emulsion and adding an aqueous solution of the hardener emulsified in the tensid containing organic solvent which already is part of the gelatine emulsion. In this way an especially uniform hardening of the gelatine particles can be obtained.

Any of the known mixing apparatus which have a high shear gradient may be used as dispersion apparatus for preparing the water-in-oil emulsions and for subsequently redispersing the hardened gelatine particles.

The procedure described above can be used for emulsifying and hardening aqueous solution containing from 6 to 30% by weight of gelatine. More highly concentrated solutions are too viscous for this method and give rise to excessively coarse gelatine particles. Where it is necessary to start from more highly concentrated gelatine solutions, the gelatine may be hydrolysed or broken down by enzyme action, for example with the aid of pepsin, papain or trypsin.

The matting process according to the invention may be applied to photographic layers which contain gelatine as binder, in other words it is applicable both to light-sensitive emulsion layers and to light insensitive photographic auxiliary layers such as protective layers, interlayers, filter layers or backing layers. The process is mainly intended for matting the outermost layers of photographic materials, for example the exposed silver halide emulsion layers, protective layers and/or backing layers. On the other hand, it may also be advantageous to matt internally situated layers such as interlayers or filter layers in order to prevent damage such as tears or patches due to contact or sticking during the individual stages of the process of manufacturing multilayer photographic materials.

In the process according to the invention, the dispersions of the matting agents are added to the casting compositions of the photographic gelatine layers so that, in the case of protective layers, from 5 to 50% by weight of the gelatine in the casting composition, generally 10 to 30% by weight, is replaced by modified gelatine. These figures are based on the dry weight of gelatine.

The size of the hardened gelatine particles obtained and hence the fineness of the matt effect can easily be influenced by controlling the conditions under which the emulsifying process is carried out. Increasing the quantity of the emulsifier used results in smaller particles and therefore finer matting. Smaller particles are also obtained by more vigorous mixing, a longer emulsification time and lower viscosity of the gelatine solution. if gelatine particles with a very low capacity to swell are required for certain purposes, the water-in-oil emulsion may first be further dehydrated and then hardened. Dehydration can be effected by the addition of dehydrating agents such as calcium chloride and sodium sulphate or by azeotropic distillation of the emulsion and return of the organic solvent. Gelatine concentrations of up to 50% can be obtained in this way.

The volumetric swelling is determined by the following method:

100 ml of aqueous gelatine dispersion are centrifuged until there is no further change in the volume of sediment of gelatine particles. The swelling factor Q can be calculated from the absolute gelatine content in g, the specific gravity of gelatine (1.3) and the volume of sediment V according to the equation $Q = (V.\ 1.3/g)$.

The process according to the invention makes it possible for exceptionally fine grained matted photographic gelatine layers to be obtained. The advantage of a fine grained matt effect is particularly important when the process according to the invention is used for matting extremely thin layers which form constituents of multilayered photographic materials, e.g. colour photographic materials. Moreover, using modified gelatine particles as matting agent has the effect that the refractive indices of the binder and matting agent are substantially identical, thus avoiding the undesirable optical effects which are particularly troublesome in photographic materials. Another advantage of using matting agents made of modified gelatine is that their swelling properties are very similar to those of the binder used for the layer so that the matting agents in no way interfere with the penetration of the processing baths into the layers.

The following Examples serve to explain the invention in more detail.

EXAMPLE 1

(a) Preparation of the matting dispersion 0.18 kg of glycerol monodioleate (HLB value 3.3) and 0.12 kg of polyoxyethylene glycerol monooleate (HLB value 15) were dissolved in 20 litres of cleaning petrol. 30 Liters of a 20% gelatine solution at pH 9 were then emulsified in the aforesaid solution at 40° C. with the aid of a high speed stirrer. An emulsion of 1.33 liters of 30% formalin solution in 1.33 liters of the above surface-active solution in petroleum hydrocarbons was added for hardening. After a hardening time of 2 to 3 days at room temperature, the emulsion was poured into 150 liters of methanol and 0.135 liters of glacial acetic acid to break up the emulsion. When the precipitate had settled, the petroleum hydrocarbon which separates as a supernatent layer was siphoned off and the precipitate was filtered and washed free from surfactant with the methanol. The precipitate was stirred into water while still moist, using a high speed stirrer. A gelatine dispersion containing 5% of gelatine was thereby obtained.

The size of the gelatine particles was in the region of 5 to 20 μ and the volume of the particles after swelling was 5 times the volume of the particles before swelling (swelling factor = 5).

(b) Preparation of a matted photographic layer

Four photographic silver bromide gelatine emulsions ready for casting were used, each containing 10% by weight of gelatine. In three of the emulsions, 5%, 10% and 20% by weight, respectively, of the gelatine was replaced by corresponding quantities by weight of the dispersion of matting agent described above. The four examples were cast to form layers 10 μ in thickness on a cellulose triacetate substrate covered with a bonding layer, and they were then dried.

The roughness of the surface of the layer was then determined by measuring the peak to valley height by means of a "Hommel-Tester Type T" surface measuring instrument manufactured by Hommelwerke GmbH, Mannheim-Käfertal. The results are summarised in the following Table.

| Proportion of matting dispersion in the binder content of the emulsion | Peak to Valley height in the surface of the layer in μ |
|---|---|
| Pure gelatine | 0.2 - 0.4 |
| 5% by weight | 1.0 - 2.0 |
| 10% by weight | 1.5 - 2.5 |
| 20% by weight | 2.0 - 3.0 |
| 50% by weight | 2.5 - 3.5 |

Emulsion layers which contain more than 10% by weight of the matting dispersion as binder are excellent for retouching purposes.

EXAMPLE 2

(a) Matting dispersion 0.72 kg of glycerol monodioleate (HLB value 3.3) and 0.48 kg of polyoxyethylene glycerol monooleate (HLB value 15) were dissolved in 20 l of cleaning petrol. The procedure was otherwise the same as that described in Example 1. The size of the dispersed gelatine particles was in this case in the region of from 5 to 10 μ while the volumetric swelling was unchanged.

(b) Preparation of the photographic silver halide emulsion layer was carried out as in Example 1 but only one emulsion layer was cast. It contains 10% by weight of matting agent based on the total weight of binder. The matt finish on the surface of the layer was in this case finer and had a peak to valley height of 1 to 2 μ.

EXAMPLE 3

(a) Preparation of the matting dispersion was carried out as in Example 2 but using a 10% gelatine solution instead of the 201% gelatine solution. The procedure was otherwise the same as in Example 1. The size of the particles obtained was from 3 to 5 μ and the swelling volume was about double (swelling factor 10) that obtained in Examples 1 and 2.

The procedure described in Example 1 was varied in that the filtered and washed product was stirred up in water to form a 3% dispersion of matting agent.

(b) A silver halide emulsion containing 10% by weight of gelatine and no matting agent was cast on a prepared cellulose triacetate substrate as described in Example 1 and dried.

A protective gelatine layer containing 25% by weight of the matting dispersion described above was applied to the silver halide emulsion layer in a thickness of 1 μ.

The surface of the dried protective layer had a peak to valley height of 1 to 1.5 μ and was very suitable for retouching.

EXAMPLE 4

(a) The method of preparation of the matting dispersion described in Example 1 was modified by increasing the weight of glycerol monodioleate from 0.18 to 0.72 kg and the quantity of polyoxyethylene glycerol monooleate from 0.12 to 0.48 kg and using 2.66 l instead of 1.33 l of formalin solution (30%) for hardening.

The dispersion prepared in this way contained particles measuring from 5 to 10 μ as in Example 2 but, since double the quantity of hardener was used, the particles had a greater dimension stability and a more powerful matting effect.

The matting dispersion was used for preparing protective layers as described in Example 2b. Two samples were prepared, one containing 10% by weight of the matting dispersion in a protective gelatine layer (sample 1) and the other 20% by weight (sample 2). The following results were obtained:

Sample 1: Peak to valley height 1.5–2.5 μ
Sample 2: Peak to valley height 2.0–3.0 μ.

EXAMPLE 5

(a) The preparation of the matting dispersion was initially carried out by the procedure described in Example 1, using 0.72 kg of glycerol monodioleate and 0.48 kg of polyoxyethylene glycerol monooleate in 20 l of cleaning petrol. In this case, however, the resulting emulsion was distilled in a thin layer evaporator at 40° C. under vacuum and dehydrated. The solvent used for distillation was returned to the emulsion. Distillation was continued until the emulsified gelatine solution had a concentration of about 50% by weight. It was then hardened and processed as described in Example 1. The particles obtained were smaller than those in Example 2 and range from 3 to 7 μ. The volumetric swelling was even further reduced and amounts of 2.5.

(b) A photographic material having a protective gelatine layer was prepared as described in Example 3. It contained the proportion of matting agent given in the said example.

The matting effect obtained in this way was substantially more fne grained than that obtained in Example 2 but at the same time the surface had a greater peak to valley height, amounting to 1.5 to 2 μ.

This is presumably because the particles hardened in a more highly concentrated form are less capable of deformation. They retain their spherical shape even after drying whereas the particles obtained by the methods used in the previous Examples dry to a lentil shape.

EXAMPLE 6

(a) A matting dispersion described in U.S. Pat. No. 2,043,906 was prepared as follows:

10% by weight of gelatine powder were added to a 1% formaldehyde solution in absolute alcohol and dispersed in a ball mill for 12 hours. The alcohol was then replaced by benzene and the benzene was distilled off. A gelatine powder forming a 5% by weight dispersion in water was obtained. The size of the particles fluctuate widely between 2 and 15 μ.

(b) The 5% aqueous gelatine dispersion was used for preparing a matted silver bromide gelatine emulsion layer as indicated in Example 1(b).

A peak to valley height of 8 to 12 μ was obtained. Compared with the corresponding layer obtained in Example 1, the matted layer had a clearly more visible grain in the photographic image.

We claim:

1. In a process for the production of a matt surface on a gelatin-containing layer in a photographic material containing layers having gelatin binder the steps which comprise providing an aqueous gelatin solution, and then preparing a dispersion of gelatin particles to form a first emulsion by emulsifying said gelatin in a non-polar solvent selected from the group consisting of cleaning petrol, ligroin, higher boiling paraffins, toluene, xylenes, monoethyl-, diethyl, triethyl- and propylbenzene, mesitylene, tetramethyl- and pentamethylbenzene, biphenyl, diphenylmethane, perchloroethylene and carbon tetrachloride in the presence of emulsifiers in a water-in-oil emulsion comprising an emulsifier having an HLB value of from 3 to 8 and said non-polar solvent, to provide gelatin particles of from 5 to 200 μ in size, adding to said first emulsion a second emulsion of an aqueous solution of a hardener in additional non-polar solvent in an amount to effectively contact and harden the gelatin particles, the particles being capable of swelling, separating the dispersed, hardened particles from the emulsion and the hardener and subsequently redispersing the hardened particles in water, then incorporating the hardened gelatin particles redispersion in a casting composition, applying the casting composition on a substrate, and drying the casting to a layer with a gelatin binder in which the hardened gelatin particles are contained in the binder content in an amount from 5–50% by weight of the dry weight, and to form on said layer a peak-to-valley height in the surface of the layer of not more than 3.5 μ.

2. The process as claimed in claim 1 wherein the monopolar solvent is cleaning petrol and the emulsifier is a mixture of glycerol monodioleate and polyethylene glycerol monooleate in proportions by weight of 6:4.

3. The process as claimed in claim 1 wherein the hardener is formaldehyde.

* * * * *